US008033896B2

(12) United States Patent
Amend et al.

(10) Patent No.: US 8,033,896 B2
(45) Date of Patent: Oct. 11, 2011

(54) PROTECTIVE COVER FOR A HAND-HELD CUT-OFF MACHINE

(75) Inventors: Helmar Amend, Wablingen (DE); Joachim Hoffmann, Plochingen (DE); Ernst Buck, Leutenbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 607 days.

(21) Appl. No.: 12/168,175

(22) Filed: Jul. 7, 2008

(65) Prior Publication Data

US 2009/0013541 A1 Jan. 15, 2009

(30) Foreign Application Priority Data

Jul. 13, 2007 (DE) ..... 10 2007 032 672

(51) Int. Cl.
*B24B 55/02* (2006.01)
*B24B 55/04* (2006.01)
*B28D 1/04* (2006.01)

(52) U.S. Cl. ..... 451/454; 451/455; 125/13.01

(58) Field of Classification Search ..... 451/359, 451/450, 451, 452, 454, 455; 125/13.01
See application file for complete search history.

(56) References Cited

U.S. PATENT DOCUMENTS

| | | | | |
|---|---|---|---|---|
| 3,896,783 | A * | 7/1975 | Manning | 125/13.01 |
| 4,929,130 | A * | 5/1990 | Diebolt et al. | 409/136 |
| 5,826,478 | A * | 10/1998 | Zerrer | 83/169 |
| 7,520,799 | B2 * | 4/2009 | Wedel et al. | 451/450 |
| 7,713,111 | B2 * | 5/2010 | Layher et al. | 451/450 |
| 2005/0034715 | A1 * | 2/2005 | Terpstra | 125/13.01 |
| 2006/0123638 | A1 | 6/2006 | Wedel et al. | |
| 2006/0128289 | A1 | 6/2006 | Wedel et al. | |

FOREIGN PATENT DOCUMENTS

| | | | |
|---|---|---|---|
| EP | 0459121 | A1 | 12/1991 |
| GB | 2307874 | A | 6/1997 |
| GB | 2419561 | A | 5/2006 |
| GB | 2420517 | A | 5/2006 |

* cited by examiner

*Primary Examiner* — Robert Rose
(74) *Attorney, Agent, or Firm* — Gudrun E. Huckett

(57) ABSTRACT

A protective cover of a hand-held cut-off machine has a bracket that is secured on the exterior side of the protective cover. The bracket is locked in at least one locked position with at least one locking projection in at least one receptacle of the protective cover. The bracket is releasable from the locked position by a movement of the bracket in the release direction. A simple release of the bracket can be achieved in that the protective cover has means that move the locking projection upon movement of the bracket in the release direction at least partially out of the receptacle.

17 Claims, 4 Drawing Sheets

PROTECTIVE COVER FOR A HAND-HELD CUT-OFF MACHINE

BACKGROUND OF THE INVENTION

The invention concerns a protective cover of a hand-held cut-off machine wherein the protective cover comprises a bracket secured on the exterior side of the protective cover. The bracket in at least one locked position is locked with at least one locking projection in at least one receptacle of the protective cover. The bracket, by a movement of the bracket in a release direction, is releasable from the locked position.

U.S. 2006/0128289 A1 discloses a protective cover of a hand-held cut-off machine that is provided with a bracket. The bracket serves in particular for supplying a liquid, such as water, to the cutting disc. The liquid (water) supplied through the hollow bracket serves primarily for binding dust produced during cutting as well as for cooling and lubricating the cutting disc. The protective cover can be secured on the extension arm of the cut-off machine in different positions, i.e., on both sides of the extension arm of the cut-off machine. For this purpose, the position of the bracket must be changed on the protective cover.

The bracket is exposed to high thermal stress on the protective cover. Moreover in operation strong vibrations act on the bracket. In order to ensure that the locked bracket will not be released in operation and in order to avoid thermal overload, the bracket is advantageously comprised of a strong and brittle material. When releasing the bracket from the locking means, this brittle material must be bent. This can cause overload of the material and thus breakage of the bracket.

SUMMARY OF THE INVENTION

The invention has the object to provide a protective cover of the aforementioned kind whose bracket is releasable in a simple and safe way.

This object is solved by a protective cover that has means that move the locking projection at least partially out of the receptacle upon movement of the bracket in the release direction.

In that the protective cover itself has means that effect the movement of the bracket out of the receptacle, the operator must only move the bracket in the release direction. An additional spreading of the bracket for releasing it from the receptacle is no longer required. The means provided on the protective cover determines by constructive measures how far the bracket can be spread apart. In this way, by constructive measures an overloading of the bracket can be avoided. In a simple way a safe release of the bracket is enabled and at the same time overloading of the bracket is prevented.

Advantageously, the means are arranged on the exterior side of the protective cover adjacent to the bracket in the release direction. Already for a minimal movement of the bracket from the locked position in the release direction, the bracket contacts the means and is released. A simple configuration results when the means comprise at least one guide ramp formed integrally on the protective cover. The guide ramp effects a gradual spreading and causes only a minimal mechanical loading of the bracket. In order to ensure that the bracket can be released easily from the receptacle, it is provided that the height of the guide ramp corresponds at least approximately to the engagement depth of the locking projection in the receptacle.

Advantageously, the bracket has two legs that extend on opposite sidewalls of the protective cover wherein both legs of the bracket in the locked position are locked in one receptacle of the protective cover, respectively. Advantageously, each sidewall of the protective cover has at least one guide ramp. In this way, simultaneous release of both legs of the bracket is achieved. Advantageously, the guide ramps are formed symmetrically to one another on both sidewalls. In this connection, the guide ramps are advantageously mirror-symmetrical to a plane extending between the sidewalls. In this way, the two legs of the bracket are moved and spread apart in the outward direction uniformly and symmetrically. A one-sided spreading that would lead to overloading of one of the legs is thus prevented.

The bracket can be released in a simple way when the bracket is pivotable about the receptacle for release from the locked position. The pivot movement can be carried out easily. Upon pivoting, the guide ramps effect a forced guiding action of the legs of the bracket in the outward direction and thus cause an automatic release of the bracket.

Advantageously, the protective cover comprises at least one spray nozzle and at least one supply conduit connected to the spray nozzle. The spray nozzle serves for supplying a cooling liquid, in particular cooling water, to the cutting disc of the cut-off machine.

Advantageously, one conduit section of the supply conduit passes through the bracket. A simple configuration of the protective cover results when the bracket has two legs and each leg has a spray nozzle arranged there at and when the conduit section passing through the bracket completely extends within the interior of the bracket and connects the two spray nozzles with one another. An additional connecting conduit of the two spray nozzles can thus be eliminated. Advantageously, the receptacle is an opening and the locking projection is provided on a hollow pin in which the spray nozzle is secured. The spray nozzle can supply cooling liquid through the opening to the cutting disc. The opening thus serves as a securing means for the locking projection of the bracket and as a passage for the cooling liquid. In this way, a simple configuration of the protective cover is provided.

Advantageously, the bracket has a support section that is arranged in the locked position on the outer circumference of the protective cover. In this way, the rotational position of the bracket on the outer circumference of the protective cover can be determined in a simple way. Expediently, the support section in the locked position is secured by a locking device on the circumference of the protective cover. Accordingly, in a simple way the position of the bracket can be secured wherein the bracket advantageously is locked at both ends and on the circumference of the protective cover so that a three-point support action for the bracket is provided. Expediently, the bracket is secured in the locked position by a securing means. The securing means is advantageously a securing screw. In this way, even at strong vibrations of the protective cover it is ensured that the bracket cannot become detached accidentally.

In order to achieve a minimal weight of the cut-off machine, it is provided that the protective cover is comprised of magnesium. The protective cover is advantageously produced by magnesium die casting. The bracket is comprised advantageously of fiberglass-reinforced plastic material. In particular, the bracket is comprised of fiberglass-reinforced polyphthalamide. In this way, a satisfactory temperature resistance of the bracket and at the same time a satisfactory strength can be achieved. The embodiment made from plastic material moreover provides a minimal weight of the bracket.

BRIEF DESCRIPTION OF THE DRAWINGS

One embodiment of the invention will be explained in the following with the aid of the drawing.

DESCRIPTION OF PREFERRED EMBODIMENTS

Figure 1:
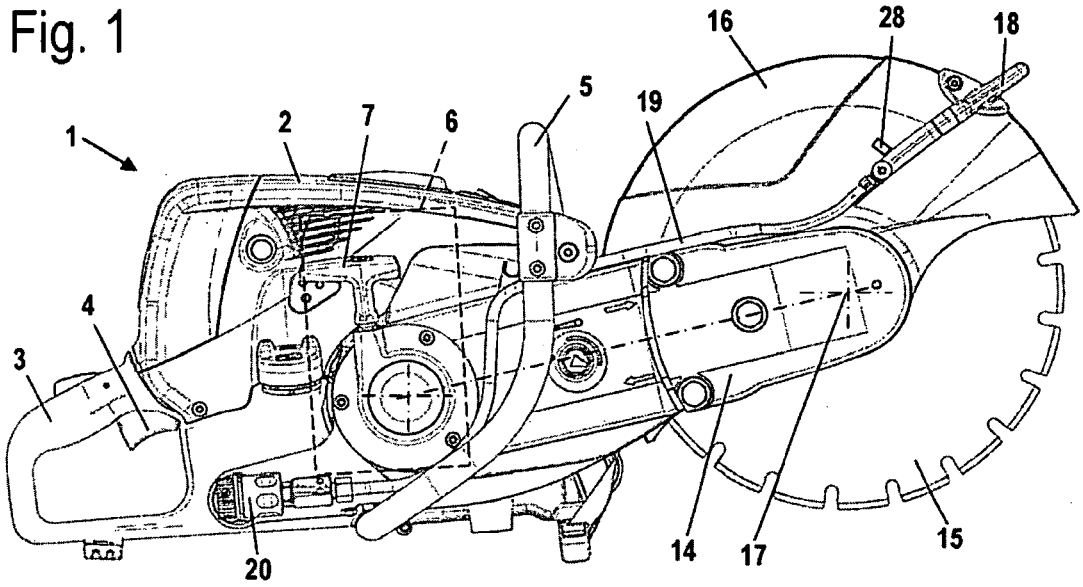
FIG. 1 shows a side view of a cut-off machine.

The cut-off machine 1 illustrated in FIG. 1 is a hand-held portable cut-off machine. The cut-off machine 1 can also be secured on a guide carriage. The cut-off machine 1 has a housing 2 on which a rear handle 3 is arranged. On the rear handle 3 a throttle lever 4 is pivotably arranged for operating a drive motor 6 arranged in the housing 2. On the housing 2, on the side facing away from the rear handle, there is a grip pipe 5 that extends across the housing 2. A starter handle 7 of a starter device 8 of the drive motor 6, shown in FIG. 2, projects from the housing 2. On the housing 2 an extension arm 14 is secured that projects forwardly; on it a cutting disc 15 is supported so as to rotate about axis of rotation 17. The cut-off disc 15 is surrounded about part of its circumference by a protective cover 16. The protective cover 16 can extend, for example, about half the circumference of the cutting disc 15.

A supply conduit 19 is provided on the cut-off machine 1 for supplying the cutting disc 15 with cooling liquid, for example, cooling water. The supply conduit 19 has a hose coupling 20 at the end neighboring the housing 2 for connecting it to a cooling medium tank. The supply conduit 19 is connected on the protective cover 16 to the bracket 18. Adjacent to the bracket 18 a guide ramp 28 is formed integrally on the protective cover 16 whose function will be explained in the following in more detail.

Figure 2:
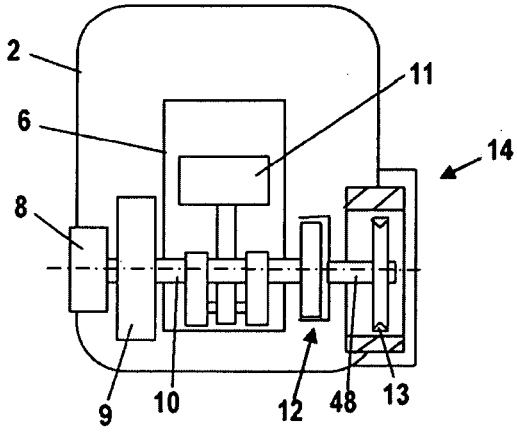
FIG. 2 is a schematic section illustration of the cut-off machine of FIG. 1.

As shown in FIG. 2, the drive motor 6 is embodied as an internal combustion engine and comprises a piston 11 that drives in rotation a crankshaft 10. Between the starter device 8 and the drive motor 6 there is a fan wheel 9 for conveying cooling air to the internal combustion engine 6. On the opposite side of the drive motor 6 there is a centrifugal clutch 12 that connects the crankshaft 10, after starting the internal combustion engine 6 and after surpassing a limit engine speed, to a shaft section 48 that drives a drive belt 13. The drive belt 13 couples the crankshaft 11 to a bearing shaft of the cutting disc 15. The drive belt 13 is guided within the extension arm 14.

Figure 3:
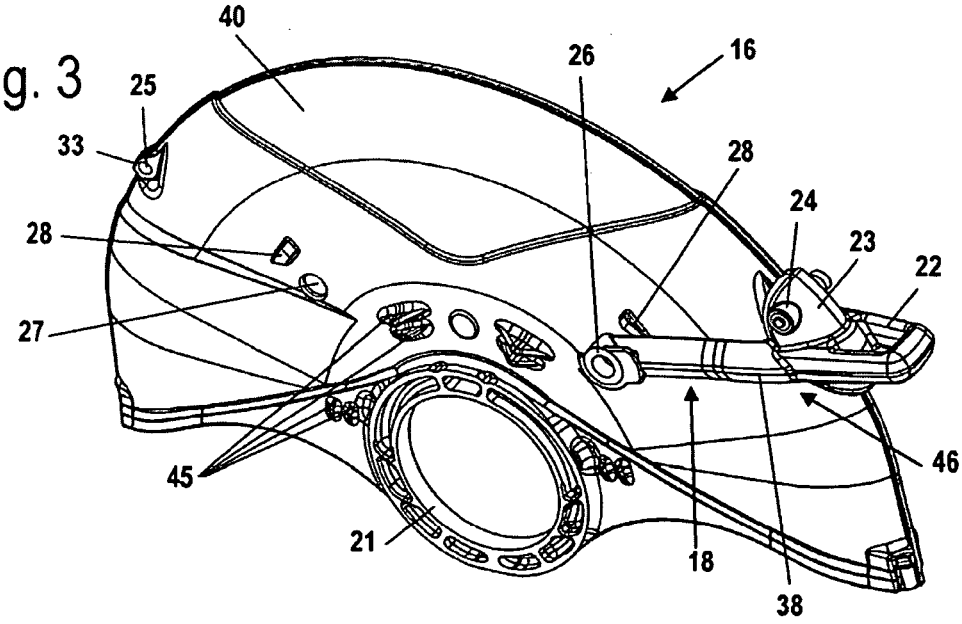
FIG. 3 is a perspective illustration of the protective cover of the cut-off machine of FIG. 1.

As shown in FIG. 3, the protective cover 16 has a hub 21 and fastening projections 45 for fixing and positionally securing the protective cover 16 on the extension arm 14. The bracket 18 has a first leg 38 shown in front in FIG. 3 that is provided with a hollow pin 26 at the end facing the axis of rotation 17. In the area of the circumference of the protective cover 16 the bracket 18 has a grip section 22 by means of which an operator can actuate the bracket 18. Between the bracket 18 and the protective cover 16 a support section 23 is arranged on the circumference of the protective cover 16. The support section 23 has a transverse opening that, in the locked position 46 of the bracket 18 shown in FIG. 3, is aligned with the fastening opening 25 of the protective cover 16. A securing means in the form of a securing screw 24 is pushed through the fastening opening 25 and provides a positive-locking positional securing action for the bracket 18. On the opposite end of the protective cover 16 a projecting portion 33 is shown in FIG. 3 and is provided with a fastening opening 25. The protective cover 16 is symmetrically designed so that the fastening opening 25 matches the fastening opening through which the securing screw 24 is pushed in the locked position 46 shown in FIG. 3. The hollow pin 26 projects through an opening 27 that in FIG. 3 is also shown for the second locked position (not shown) of the bracket 18. As shown in FIG. 3, the first leg 38 extends on the first sidewall 40 of the protective cover 16.

Figure 4:
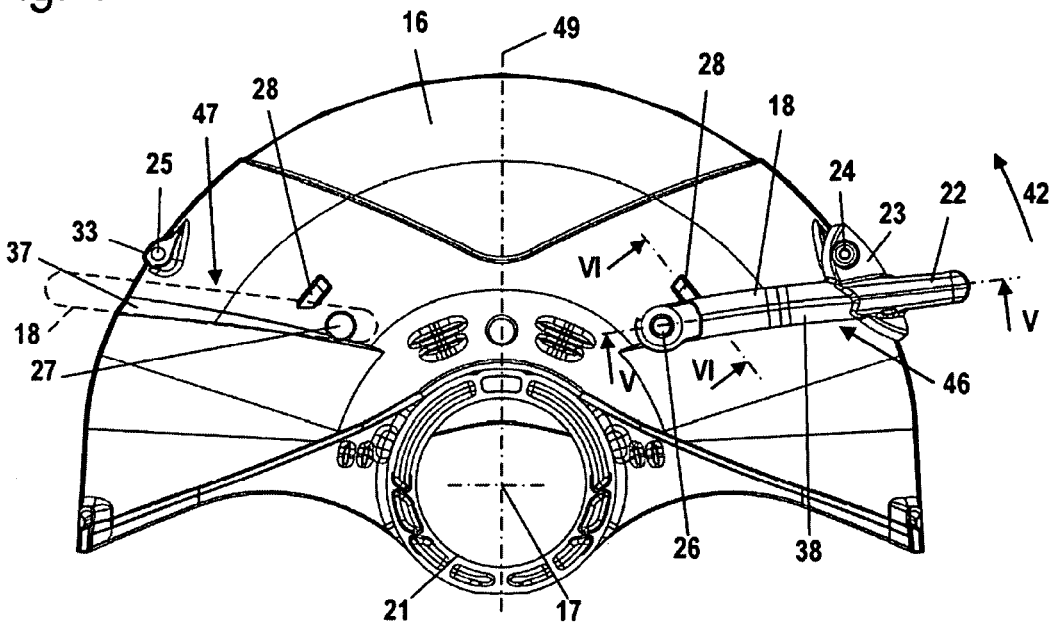
FIG. 4 is a side view of the protective cover of FIG. 3.

In FIG. 4, the symmetry plane 49 of the protective cover 16 is illustrated. The symmetry plane 49 contains the axis of rotation 17 of the cutting disc 15. In FIG. 4, the second locked position 47 of the bracket 18 is also illustrated in dashed lines. In this second locked position the bracket 18 is arranged relative to the symmetry plane 49 mirror-symmetrical to the locked position 46.

The protective cover can be secured at both sides of the extension arm 14. Because the protective cover 14 is provided with a hub 21 and fastening projections 45 only at the first sidewall 40 shown in front in FIG. 3 and FIG. 4, the protective cover is rotated when it is to be mounted in reverse. In this connection, the position of the bracket 18 must be changed also. The bracket 18 is adjusted from the first locked position 46 shown in FIG. 4 to the second locked position 47 schematically illustrated in FIG. 4. For this purpose, the bracket 18 is pivoted in the release direction 42 about the opening 27 and the hollow pin 26 that is arranged in the opening 27.

Figure 5:
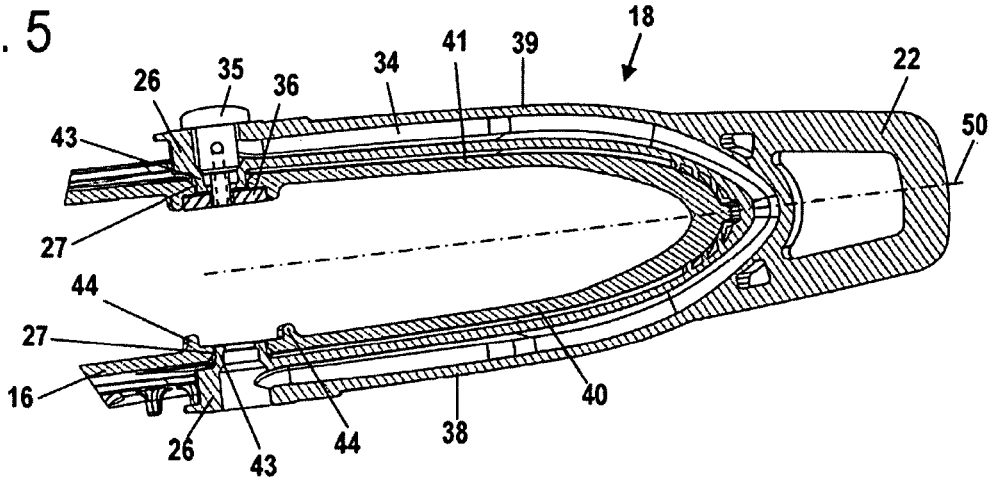
FIG. 5 shows a section of the protective cover along section line V-V of FIG. 4.

As shown in the section illustration of FIG. 5, a conduit section 34 of the supply line 19 is formed integrally on the bracket 18. The bracket 18 has two legs 38, 39 that are formed symmetrical to a symmetry plane 50. The symmetry plane 50 extends between the two sidewalls 40 and 41 of the protective cover 16 parallel to the plane of the cutting disc 15, in particular in the plane of the cutting disc 15. Each leg 38, 39 of the bracket 18 has at its end a hollow pin 26 on which a locking projection 43 is integrally formed. The locking projection 43 of the hollow pin 26 projects into the two openings 27. The interior of the two hollow pins 26 is connected by the conduit section 34.

In the interior of the protective cover 16 webs 44 are provided on both sidewalls 40, 41; the webs are formed as thicker portions of the sidewalls 40, 41. In the two hollow pins 26 a spray nozzle 45 is arranged, respectively. For simplifying the drawing, in FIG. 5 only one spray nozzle 35 on the leg 39 is shown. The spray nozzle 35 connects the cavity formed between the hollow pin 26 and the spray nozzle 35 with the interior of the protective cover 16. In this connection, the spray nozzle 35 extends through the receiving opening 27. For fixation, the spray nozzle 45 is screwed into a square nut 36 that is fixedly secured between the two webs 44 so as not to rotate. On the opposite side, on the first leg 38 a connecting member, not shown, is provided at the hollow pin 26 for connecting it to the supply conduit 19.

Figure 6:
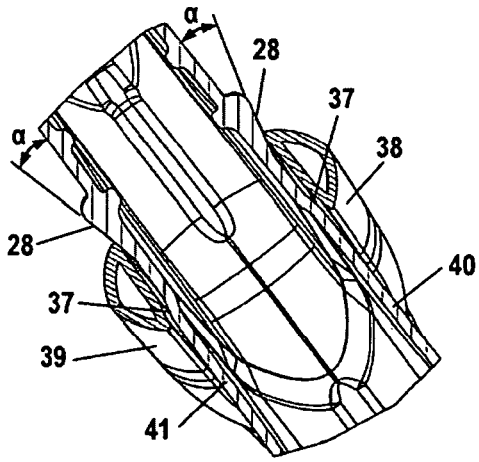
FIG. 6 is a section view of a detail of the protective cover along the line VI-VI of FIG. 4.

As shown in the section illustration of FIG. 6, the guide ramps 28 are embodied to project outwardly beginning at the legs 38 and 39 of the bracket 18. The guide ramp 28 extends at an angle to the sidewalls 40 and 41; the angle is advantageously approximately 5° up to approximately 30°.

Figure 7:
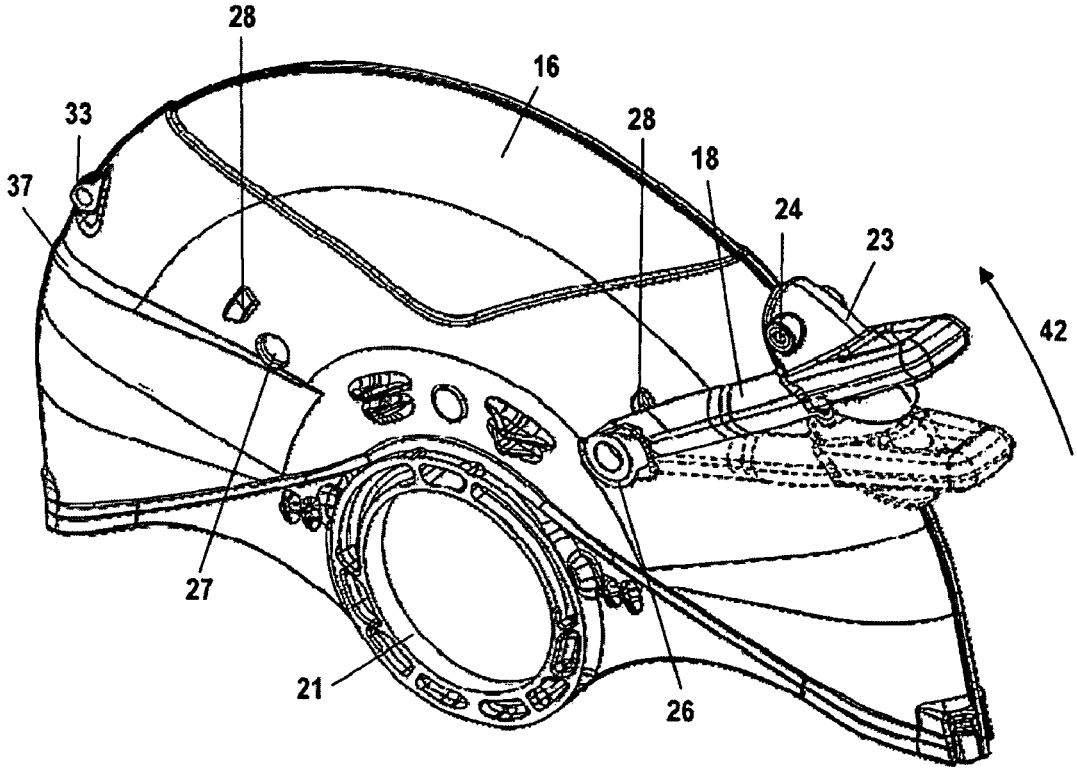
FIG. 7 is a perspective illustration of the protective cover when releasing the bracket.
Figure 8:
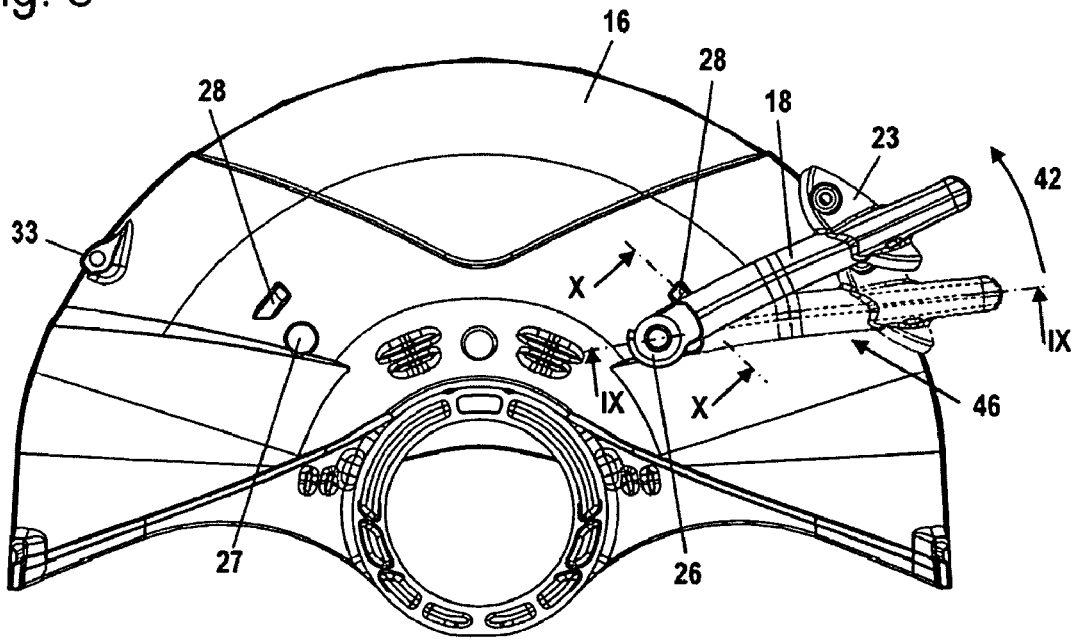
FIG. 8 is a side view of the protective cover when releasing the bracket.
Figure 9:
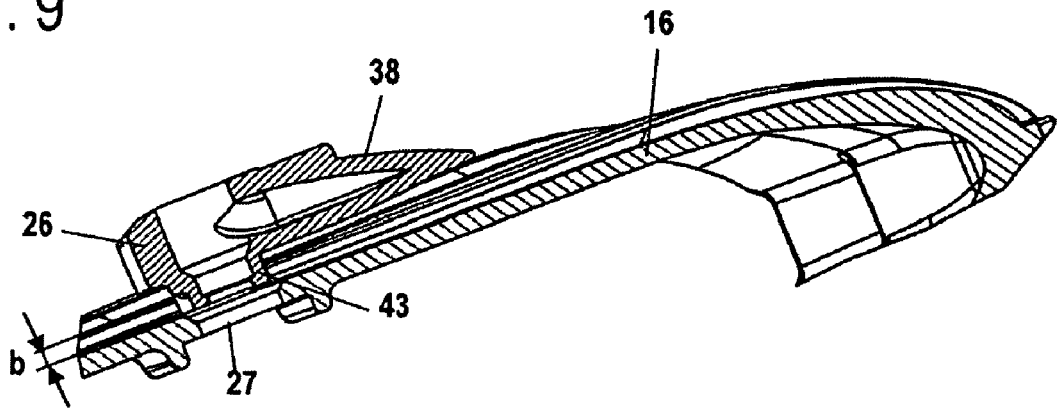
FIG. 9 is a sectioned illustration of a detail along the line IX-IX of FIG. 8.
Figure 10:
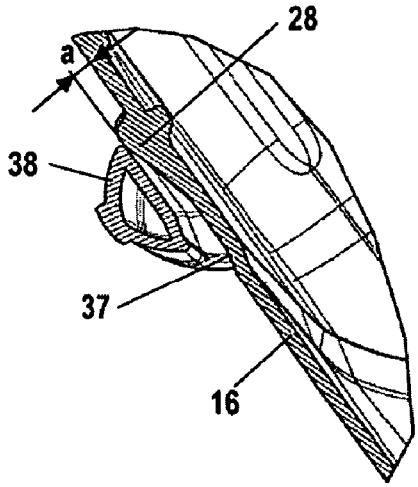
FIG. 10 is a sectioned illustration of a detail along the line X-X of FIG. 8.

For releasing the bracket 18, the bracket 18 is moved in the release direction 42. This is illustrated in FIG. 7. For this purpose, first the screw 24 is released. The support section 23 is locked in locked positions 46, 47 on a locking device in the form of projecting portion 33 on the outer circumference of the protective cover 16. This locking action is released by movement of the bracket 18 in the release direction 42. When pivoting the bracket 18 in the release direction 42, the legs 38, 39 of the bracket 18 reach the area of the guide ramps 28. This is shown in FIG. 10. The legs of the bracket 18 glide on the guide ramps 28 that are provided on either side of the protective cover 16 symmetrical to the symmetry plane 50 (FIG. 5). In this way, the legs 38, 39 are moved outwardly and spread apart. This has the effect that the locking projections 43 are lifted out of the receiving openings 27. This is shown in FIG. 9 for the leg 38 of the bracket 18. The guide ramps 28 in the embodiment are arranged close to the openings 27. In order to achieve complete lifting of the locking projection 43, the height a of the guide ramp 28, measured perpendicular to the symmetry plane 50, matches at least the engagement depth b of the locking projection 43 illustrated in FIG. 9. The guide ramps 28 integrally formed symmetrically on both sidewalls 40, 41 effect a uniform spreading of the legs 38 and 39 of the bracket 18 so that an excessive loading of one leg is prevented.

As shown in FIG. 4, the protective cover 16 has steps 37 that extend approximately in the direction of the bracket 18 when in the locked position 46, 47; one step is shown in FIG. 4. As shown in FIG. 6 for the locked position 46, the legs 38, 39 are positioned adjacent to the steps 37 formed integrally on the two sidewalls 40, 41. In this way, an additional positional securing action of the bracket 18 is provided.

Instead of the guide ramps 28 other means for releasing the locking projections 43 from the openings 27 can be provided.

It is provided that the protective cover 16 is comprised of magnesium and is produced in particular by magnesium die casting. The bracket 18 is comprised advantageously of fiberglass-reinforced plastic material so that a satisfactory temperature resistance and a satisfactory strength are provided. Advantageously, the bracket 18 is comprised of fiberglass-reinforced polyphthalamide (PPA).

The specification incorporates by reference the entire disclosure of German priority document 10 2007 032 672.8 having a filing date of 13 Jul. 2007.

While specific embodiments of the invention have been shown and described in detail to illustrate the inventive principles, it will be understood that the invention may be embodied otherwise without departing from such principles.

What is claimed is:

1. A protective cover assembly of a hand-held cut-off machine, the protective cover assembly comprising:

a protective cover having at least one receptacle;

a bracket secured on an exterior side of the protective cover;

wherein the bracket has at least one locking projection and is locked in a locked position in that the at least one locking projection engages the at least one receptacle of the protective cover;

wherein the bracket, by a movement of the bracket in a release direction, is releasable from the locked position;

wherein the protective cover has means that, when the bracket is moved in the release direction, spread apart the bracket and move the at least one locking projection at least partially out of the at least one receptacle.

2. A protective cover assembly of a hand-held cut-off machine, the protective cover assembly comprising:

a protective cover having at least one receptacle;

a bracket secured on an exterior side of the protective cover;

wherein the bracket has at least one locking projection and is locked in a locked position in that the at least one locking projection engages the at least one receptacle of the protective cover;

wherein the bracket, by a movement of the bracket in a release direction, is releasable from the locked position;

wherein the protective cover has means that move the at least one locking projection at least partially out of the at least one receptacle when moving the bracket in the release direction; and wherein the means are arranged on the exterior side of the protective cover adjacent to the bracket in the release direction.

3. A protective cover assembly of a hand-held cut-off machine, the protective cover assembly comprising:

a protective cover having at least one receptacle;

a bracket secured on an exterior side of the protective cover;

wherein the bracket has at least one locking projection and is locked in a locked position in that the at least one locking projection engages the at least one receptacle of the protective cover;

wherein the bracket, by a movement of the bracket in a release direction, is releasable from the locked position;

wherein the protective cover has means that move the at least one locking projection at least partially out of the at least one receptacle when moving the bracket in the release direction; and wherein the means comprise at least one guide ramp integrally formed on the protective cover.

4. The protective cover assembly according to claim 3, wherein the at least one guide ramp has a height that matches at least approximately an engagement depth of the at least one locking projection in the at least one receptacle.

5. The protective cover assembly according to claim 3, wherein the bracket has two legs that extend across opposite sidewalls of the protective cover, wherein the two legs each are locked in the locked position in one of the at least one receptacle, respectively, and wherein the sidewalls each have one of the at least one guide ramp.

6. The protective cover assembly according to claim 5, wherein the guide ramps on the sidewalls are symmetric to one another.

7. The protective cover assembly according to claim 1, wherein the bracket is pivotable about the at least one receptacle for release from the locked position.

8. The protective cover assembly according to claim 1, wherein the protective cover comprises at least one spray nozzle and at least one supply conduit connected to the at least one spray nozzle.

9. The protective cover assembly according to claim 8, wherein a conduit section of the supply conduit passes through the bracket.

10. The protective cover assembly according to claim 9, wherein the bracket has two legs each provided with one of the at least one spray nozzle, wherein the conduit section passing through the bracket extends completely within an interior of the bracket and connects the spray nozzles to one another.

11. The protective cover assembly according to claim 8, wherein the at least one receptacle is an opening and the at least one locking projection is formed on a hollow pin of the bracket, wherein the at least one spray nozzle is secured in the hollow pin.

12. The protective cover assembly according to claim 1, wherein the bracket has a support section that is arranged in the locked position of the bracket on an outer circumference of the protective cover.

13. The protective cover assembly according to claim 12, wherein the support section in the locked position of the bracket is secured on the circumference of the protective cover by a locking device.

14. A protective cover assembly of a hand-held cut-off machine, the protective cover assembly comprising:

a protective cover having at least one receptacle;

a bracket secured on an exterior side of the protective cover;

wherein the bracket has at least one locking projection and is locked in a locked position in that the at least one locking projection engages the at least one receptacle of the protective cover;

wherein the bracket, by a movement of the bracket in a release direction, is releasable from the locked position;

wherein the protective cover has means that move the at least one locking projection at least partially out of the at least one receptacle when moving the bracket in the release direction;

wherein the bracket is secured in the locked position by a securing means and wherein the securing means is a securing screw.

15. The protective cover assembly according to claim 1, wherein the protective cover is comprised of magnesium.

16. A protective cover assembly of a hand-held cut-off machine, the protective cover assembly comprising:

a protective cover having at least one receptacle;

a bracket secured on an exterior side of the protective cover;

wherein the bracket has at least one locking projection and is locked in a locked position in that the at least one locking projection engages the at least one receptacle of the protective cover;

wherein the bracket, by a movement of the bracket in a release direction, is releasable from the locked position;

wherein the protective cover has means that move the at least one locking projection at least partially out of the at least one receptacle when moving the bracket in the release direction; and wherein the bracket is comprised of fiberglass-reinforced plastic material.

17. The protective cover assembly according to claim 16, wherein the fiberglass-reinforced plastic material is polyphthalamide.

* * * * *